United States Patent [19]

Cormier et al.

[11] 4,255,044

[45] Mar. 10, 1981

[54] CLEANING BLADE FOR ELECTROPHOTOGRAPHY

[75] Inventors: Raymond G. Cormier; Austin Davis, both of Nashua, N.H.; Jacques Guiguizian, Haverhill, Mass.; Leo O. Lutz, Hollis; Henry T. Pauk, Nashua, both of N.H.

[73] Assignee: Nashua Corporation, Nashua, N.H.

[21] Appl. No.: 56,129

[22] Filed: Jul. 9, 1979

[51] Int. Cl.[3] ..... G03G 21/00

[52] U.S. Cl. ..... 355/15; 15/256.51; 118/652

[58] Field of Search ..... 355/15, 3 R; 15/256.51; 118/652

[56] References Cited

U.S. PATENT DOCUMENTS

| | | | |
|---|---|---|---|
| Re. 29,418 | 9/1977 | Hunt | 15/256.51 |
| Re. 29,632 | 5/1978 | Tanaka et al. | 355/15 X |
| 2,767,529 | 10/1956 | Scott | 15/256.51 |
| 3,848,992 | 11/1974 | Smith | 355/15 |
| 3,859,691 | 1/1975 | Katayama | 15/256.51 |
| 3,927,936 | 12/1975 | Komori et al. | 355/15 |

FOREIGN PATENT DOCUMENTS

| | | | |
|---|---|---|---|
| 978988 | 1/1965 | United Kingdom | 15/256.51 |

*Primary Examiner*—R. L. Moses

*Attorney, Agent, or Firm*—Kenway & Jenney

[57] ABSTRACT

Disclosed are blades oriented in a trailing configuration for cleaning residual toner from the photosensitive drums of photocopying machines without marring the drum's surface. In one embodiment of the invention, the blade is constructed of layers of resilient material having different moduli of elasticity resulting in the blade's having greater resistance to transverse deformation than to deformation along the primary axis of the blade. In another embodiment, the blade comprises a mass of an elastic material having a partially hollow interior. The hollow interior results in a blade with differing moduli of elasticity in different directions.

11 Claims, 4 Drawing Figures

CLEANING BLADE FOR ELECTROPHOTOGRAPHY

BACKGROUND OF THE INVENTION

This invention relates to blades for removing the residual toner from the surface of the photosensitive rotating drum of photocopiers, and, more particularly, to resilient blades in a trailing configuration. It is known to clean the surface of a photosensitive drum of a photocopier with resilient blades which are supported in either a leading or a trailing configuration. A trailing blade creates on the upstream side of the rotating drum an acute angle subtended by the tangent plane to the rotating drum through the line of blade contact and a plane corresponding to the primary axis of the blade, that is, an angle less than 90°.

With conventional trailing blades the resultant of the friction and normal forces on the blade allow toner or foreign matter relatively easily to lift the blade from the drum reducing thereby cleaning effectiveness. In addition, because of the relative ease with which a prior art trailing blade can be urged away from the surface of the drum, these trailing blades typically catch or trap small particles and are more likely to mar the photosensitive surface of the drum.

An object of this invention, therefore, is a trailing cleaning blade which has excellent toner removing capability, while at the same time minimizing the trapping of toner and other particles between the blade and drum thereby causing scratching of the photosensitive surface.

A further object of the invention is such a trailing blade which is not only highly effective, but also easily fabricated, reliable, and of uncomplicated mechanical construction.

A still further object of the invention is an integral trailing blade and liquid dispensing means for lubricating the blade-drum surface interface.

SUMMARY OF THE INVENTION

In this disclosure, the cleaning blade, having a substantially rectangular cross section, is defined to have a primary blade axis parallel to the long axis of the operative portion of the blade cross section, and a transverse blade axis perpendicular to the primary blade axis. For a trailing configuration, therefore, the primary blade axis forms an acute angle with the tangent to the rotating drum as measured on the upstream side of the rotating drum.

The apparatus for removing residual toner from the photosensitive surface of the rotating drum of a photocopying machine according to the present invention comprises a rotating drum having a photosensitive surface, an elastic cleaning blade having a cleaning edge, and holding means for disposing the cleaning edge of the blade for contact with the surface of the drum along the drum surface axial length as a trailing blade. The cleaning blade features at least one elastic material for providing the cleaning edge with a primary blade axis effective modulus of elasticity and a transverse blade axis effective modulus of elasticity, the primary blade axis effective modulus of elasticity being less than the transverse blade axis effective modulus of elasticity.

The cleaning blade in one important embodiment of the present invention comprises a layer of a relatively lower elastic modulus material disposed between layers of a relatively higher elastic modulus material. These layers extend in a direction transverse to the primary blade axis, with one of the layers of the relatively higher elastic modulus material comprising the cleaning edge. This layered construction causes the blade to deform more readily in the direction along the primary blade axis than in the direction transverse to the primary blade axis. Thereby, a particle trapped between the blade and the drum surface can more easily be washed away than with conventional trailing blade structures.

In another important embodiment, the cleaning blade comprises relatively high elastic modulus material having a partially hollow interior extending in a direction parallel to the rotation axis of the photosensitive drum. The hollow interior is defined by relatively thin side walls extending in the direction of the primary blade axis and connecting substantially transversely extending first and second layers of the elastic material. The partially hollow interior results in the blade's deforming more readily in the direction along the primary blade axis than along the transverse blade axis. In still another embodiment of the invention disclosed herein, the cleaning blade comprises a relatively high modulus of elasticity material having a partially hollow interior portion filled with a relatively low modulus of elasticity material. The blade thereby deforms more readily in the direction along the primary blade axis than in the direction along the transverse blade axis.

It is preferred that the blade holding means further comprises means for pivoting the cleaning blade from an operative position contacting the drum surface to an inoperative position spaced away from the drum surface. In addition, the above described embodiments preferably comprise a rigid member closely spaced apart from the blade and adapted for limiting the deflection of the blade in the direction of the transverse blade axis when the blade is in the operative position.

Yet another embodiment of the invention further comprises a cleaning roller in contact with the drum surface and dispensing means for applying lubricating liquid onto the drum surface and the cleaning roller. The blade holding means is further adapted for supporting the dispensing means. It is preferred that the lubricating liquid be developer solution.

BRIEF DESCRIPTION OF THE DRAWINGS

The present invention will be better understood and other objects, features, and advantages will become apparent with reference to the following drawings of which.

DESCRIPTION OF PREFERRED EMBODIMENTS

The cleaning blade disclosed herein is designed for use in particular with photocopying machines employing liquid development. In such a machine, a latent electrostatic image is formed on the surface of a rotating photosensitive drum. After latent image formation, the selectively charged drum is brought into contact with the liquid developer containing toner particles. The toner particles selectively adhere to the drum thereby developing the image. After such development, the image is then transferred to the copy material, usually ordinary paper. Because some residual toner remains on the photosensitive drum surface after image transfer, this surface must be cleaned before the next latent image is formed.

In describing the various embodiments disclosed herein the same numbers will be used for corresponding parts throughout the figures.

Figure 1:
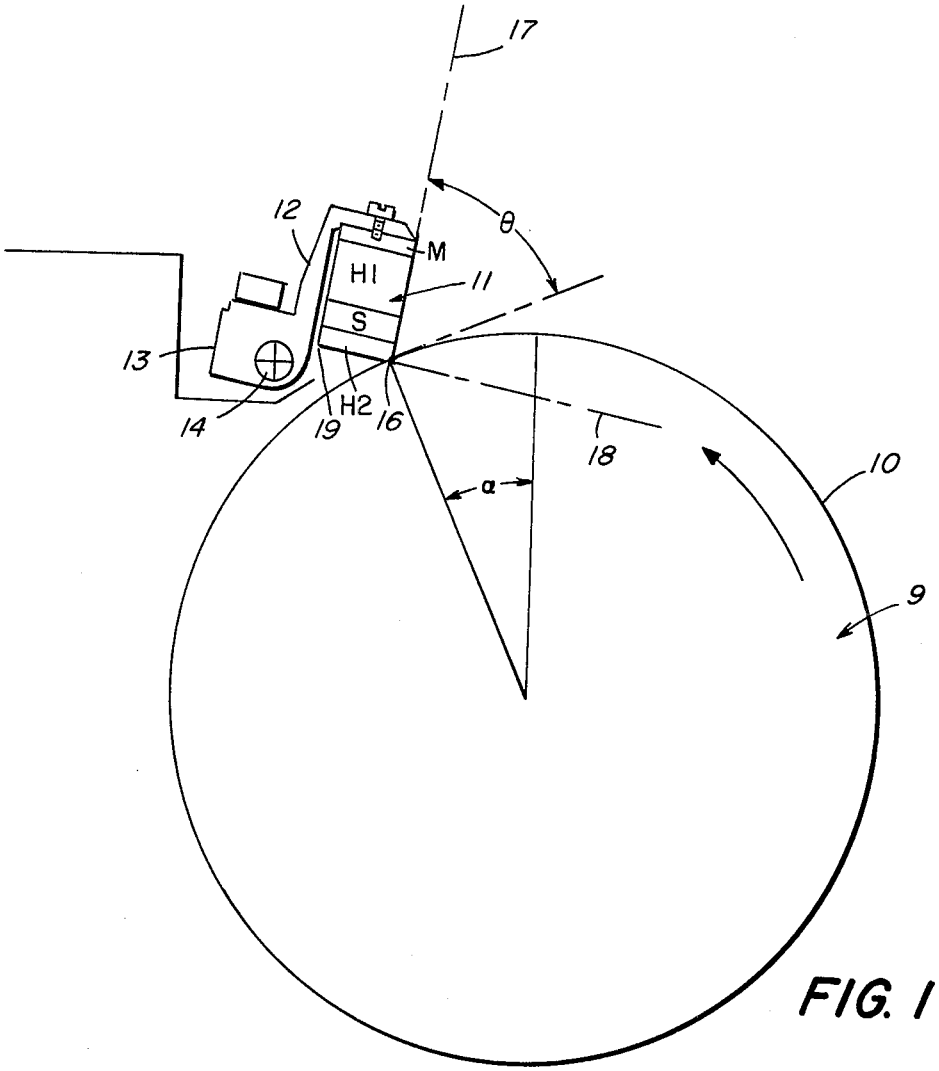
FIG. 1 is a cross-sectional view of one embodiment of the invention disclosed herein.

Referring first to FIG. 1, a rotating drum 9 is in contact with a trailing cleaning blade 11 so that as a photosensitive surface 10 rotates, any residual toner particles remaining on the surface after the transfer operation are wiped from the surface. Cleaning blade 11 is attached to a bracket 12, for example, by a plurality of screws spaced along its length parallel to the drum axis, and bracket 12 in turn is attached to a pivotable member 13. The member 13 is adapted to fit on a shaft (not shown) at a hole 14 which allows the blade assembly to pivot toward and away from photosensitive surface 10. An edge 16 of blade 11 contacts the photosensitive surface 10 and wipes residual developer therefrom. The blade assembly is located so that the edge 16 contacts photosensitive surface 10 at an angle $\alpha$ past the top position of photosensitive surface 10. A suitable value for the angle $\alpha$ is 24°.

In this embodiment, the illustrated blade 11 has a metal support surface M, such as aluminum, and three resilient layers: a soft layer (that is, a layer of a material having a relatively lower modulus of elasticity) S flanked by two layers H1 and H2 of a relatively harder material. Suitable materials for the layers S, H1 and H2 are elastic synthetic resins and rubbers which will not "poison" or be degraded by the developer solution. Typical materials can be composed of teflon, silicon rubber, polyester, polyethylene, polyurethane, etc. It is preferred that layers H1 and H2 be made of polyurethane having a hardness of 75–80 Durometer (Shore A) and that layer S be made of closed cell medium neoprene. A suitable material for layer H1 is Elastacast® polyurethane available from Acushnet Company. The bracket 12 can be made of chromic acid anodized or clear anodized aluminum. Blade 11 also has, at either end, vertical side members (not shown) which extend in a radial direction outside and below the surface of the drum. The side members can wipe against the drum edges for preventing liquid developer in front of the trailing blade from moving around the blade to the back side of the blade.

Before the layers are assembled to create blade 11, the layer H1 polyurethane is treated with Eccoprime. The layers are then bonded to one another and, in the illustrated embodiment, to metal layer M using semi-rigid formula Eccobond 45 (clear) adhesive and Catalyst-15 (clear). A suitable composition is one part adhesive to two parts catalyst by weight. These materials are available from Emerson and Cuming, Inc. of Canton, Massachusetts. The adhesive composition is cured for approximately forty-five minutes at a temperature of 160° F. (71° C.). In the embodiment of FIG. 1, layer H1 is approximately ⅜" thick, layer S, 3/16" thick, and layer H2, ⅛" thick. The width of blade 11, that is, the dimension in the direction perpendicular to a primary blade axis 17, i.e., a transverse blade axis 18, is approximately 0.5".

The blade structure described above resists transverse blade axis deformations relatively more than deformations along the longitudinal blade axis 17. The relatively high transverse stiffness of the blade 11 enhances its toner removal capability, while at the same time the relative deformability along primary blade axis 17 prevents toner particles from becoming wedged in the space between the blade 11 and photosensitive surface 10, thereby reducing the likelihood that photosensitive surface 10 will be scratched by toner or other particles. Illustrated blade 11 can also be reversed, in the preferred embodiment, so that blade edge 19 can also be used as a blade wiping edge in contact with the photosensitive surface.

The illustrated blade 11 is oriented with respect to photosensitive surface 10 so that it is a trailing blade, that is, the angle $\theta$ subtended by a tangent to the photosensitive surface 10 at the line of contact between the surface 10 and the blade 11 and the primary blade axis 17 is less that 90°. The preferred value for the angle $\theta$ is approximately 56°. Still referring to FIG. 1, the bracket 12, in addition to supporting the blade 11, can limit the amount of transverse deflection of the blade 11 to a predetermined maximum amount, for example, 1/16 ".

Figure 2:
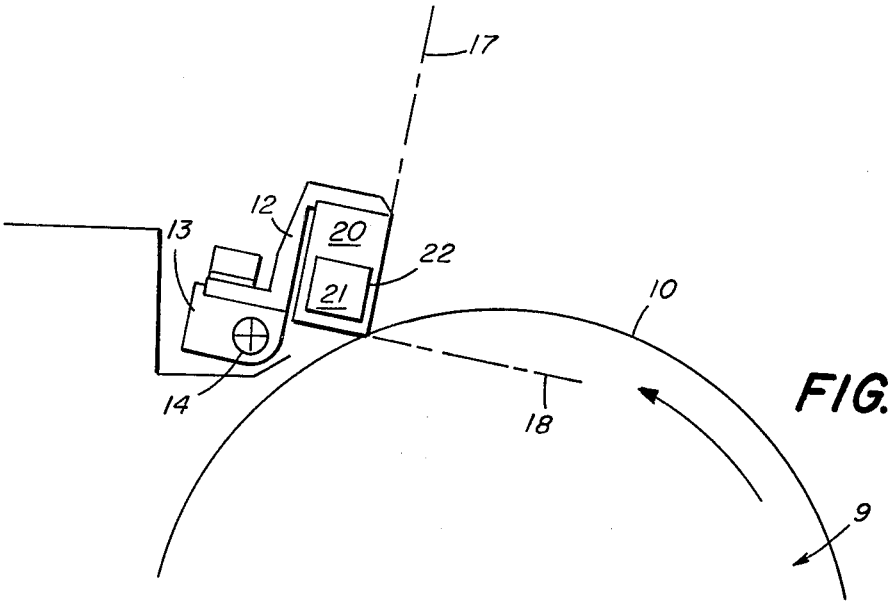
FIG. 2 is a cross-sectional view of another embodiment of the present invention.

Now referring to FIG. 2, a second illustrated embodiment of the invention, a trailing cleaning blade 20 is made of a relatively hard elastic material such as a hard polyurethane and has a cavity 21 created within the blade 20 either in the forming process or by removing some of the blade material after the complete solid blade is formed. In this embodiment blade 20 is adhesively bonded to supporting bracket 12. The resulting blade 20, having thin side walls 22 of a hard, elastic material and defining in part the cavity 21 results in blade 20 having relatively high transverse stiffness for efficient cleaning with relatively low stiffness along the primary blade axis 17 to prevent drum surface scratching and the trapping of solid particulate.

Figure 3:
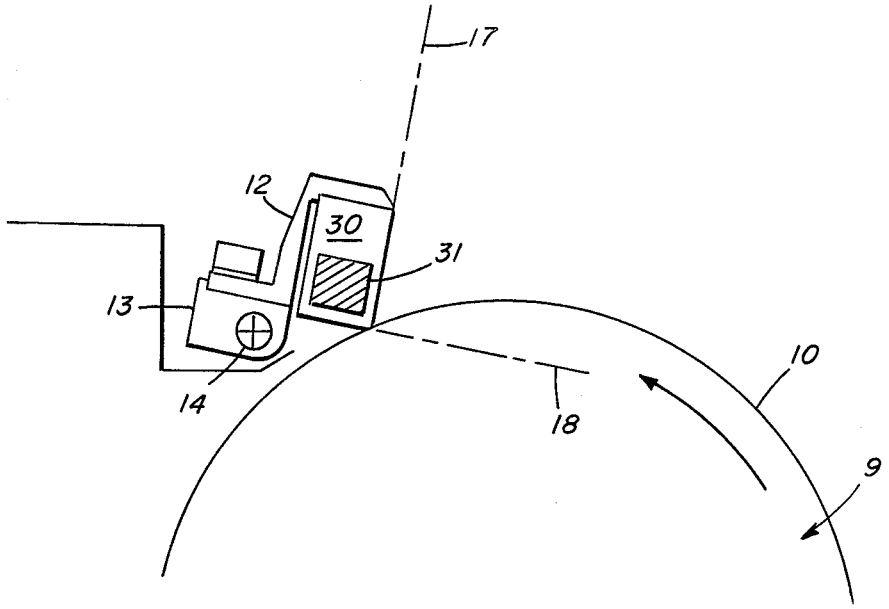
FIG. 3 is a cross-sectional view of yet another embodiment of the invention.

Yet another embodiment of the invention is shown in FIG. 3. An illustrated trailing cleaning blade 30 is made of a relatively hard elastic material which has a cavity filled with a relatively softer elastic material 31. The cavity can be created in the forming process, for example, or by removing material from the blade. As with the other embodiments described above, this arrangement of a relatively softer material embedded within a relatively harder material results in the blade 30 having relatively high stiffness transversely and relatively less stiffness along the primary blade axis 17.

Figure 4:
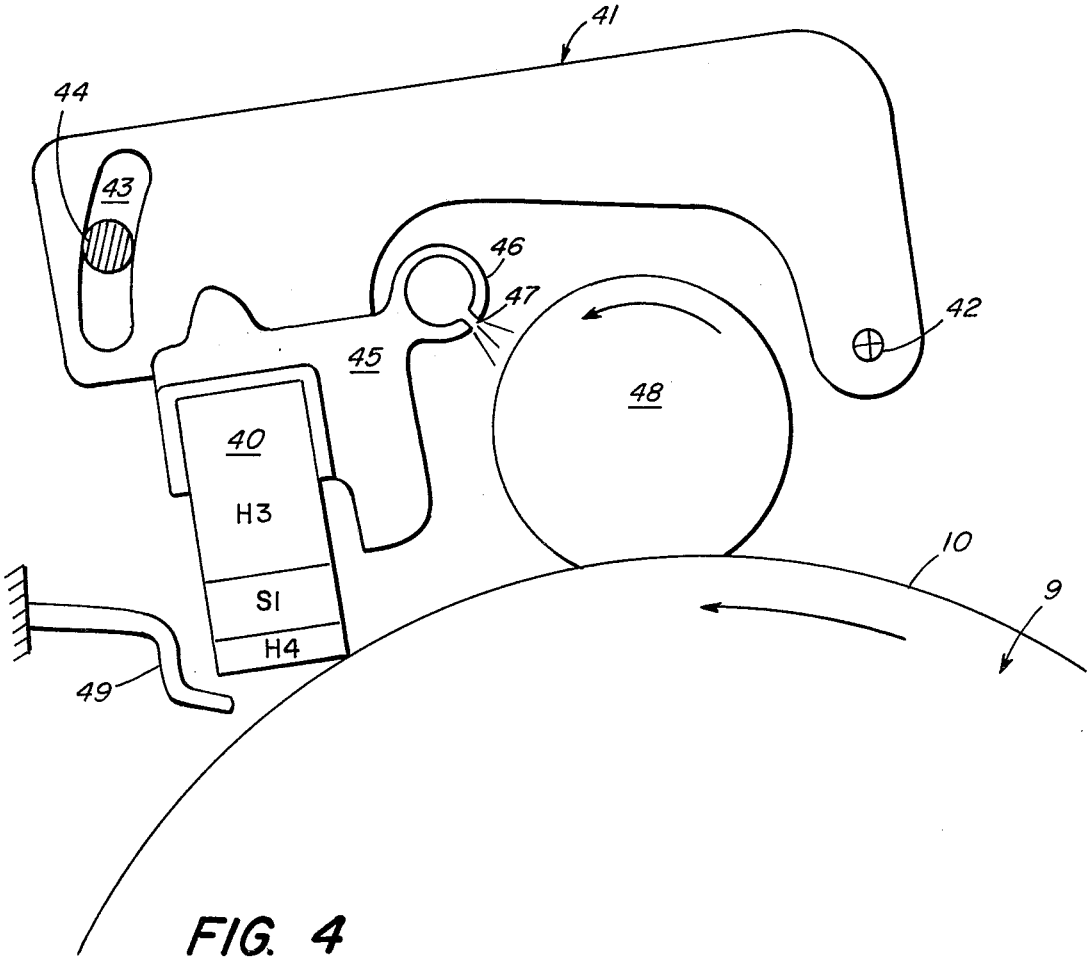
FIG. 4 is a cross-sectional view of a still further embodiment of the invention.

Referring now to FIG. 4, according to yet another embodiment of the invention, a trailing blade 40 is supported, for example, by an adhesive bond, by a pivoting bracket 41 arranged to pivot about a pivot line 42. A slot 43 in bracket 41 rides on a guiding pin 44 secured to the frame of the photocopying apparatus (not shown). The blade 40 of this embodiment is similar to the blade illustrated in FIG. 1, that is, the blade 40 is composed of three resilient layers: two hard layers H3 and H4 flanking a softer layer S1. It is to be understood that the blades described in FIGS. 2 and 3 are also suitable for use in this embodiment.

Bracket 41 pivotably supports a lubricant dispensing assembly 45 including a perforated tube 46. By conventional means (not shown), lubricating liquid, preferably developer liquid, is pumped into the tube 46. The tube 46 extends the full length of drum 9. The fluid then travels through perforations 47 onto the surface of a cleaning roller 48. These perforations are preferably spaced apart along the length of the tube 46. The cleaning roller 48 rotates in the same sense as photosensitive drum 9 so that the surface of roller 48 and photosensitive surface 10 are moving in opposite directions at their area of contact. Because the surfaces are moving in opposite directions, some of the lubricating fluid from the perforations 47 is squeezed from the roller 48 and flows by gravity and friction to the position where the blade 40 contacts the photosensitive surface 10. Such lubrication makes less likely the marring of the photosensitive surface 10 because of toner particles trapped between the photosensitive surface 10 and the blade 40. A bracket 49 is positioned to limit transverse deflection of the blade 40.

SUMMARY OF ADVANTAGES AND UNOBVIOUSNESS OF THE INVENTION

The trailing cleaning blade disclosed herein is highly effective for removing residual toner from the photosensitive drum surface of photocopying machines without marring the drum surface. This is so because of the unique blade construction combined with the blade's orientation as a trailing blade.

The blade constructions disclosed herein result in different moduli of elasticity or resistance to deformation in different directions. In particular, these blades are stiffer in a transverse direction than in the direction parallel to the primary blade axis. The transverse stiffness assures good cleaning. The relative compliance along the blade minimizes the tendency for toner particles or other debris to become trapped between drum surface and blade. Such trapping can seriously damage the drum surface.

Other efforts in the cleaning blade art neither anticipate nor suggest the unique blade construction disclosed herein; nor do they enjoy the advantages found in the present invention. By way of example, Komori et al, U.S. Pat. No. 3,927,936; Tanaka et al, U.S. Pat. No. Re. 29,632; and Katayama et al, U.S. Pat. No. 3,859,691 disclose resilient leading scraping blades; and in particular, Katayama et al teach away from the use of trailing blades.

Additions, subtractions, deletions and other modifications of the blade construction disclosed herein will occur to those skilled in the art and are within the scope of the appended claims.

What is claimed is:

1. In an apparatus for removing residual toner from the photosensitive drum surface of a photocopying machine comprising:

(1) a rotating drum having a photosensitive surface;

(2) an elastic cleaning blade having a cleaning edge; and (3) holding means for disposing said cleaning edge of said blade for contact with the photosensitive surface of said drum along the drum surface axial length as a trailing blade;

the improvement wherein said cleaning blade comprises at least one elastic material for providing said cleaning edge with a primary blade axis effective modulus of elasticity and a transverse blade axis effective modulus of elasticity, and said primary blade axis effective modulus of elasticity is less than said transverse blade axis effective modulus of elasticity.

2. The apparatus of claim 1 in which said blade comprises a layer of a relatively lower elastic modulus material disposed between layers of a relatively higher elastic modulus material, said layers extending in a direction transverse to said primary blade axis.

3. The apparatus of claim 1 in which said blade comprises a relatively high elastic modulus material having a partially hollow interior extending in a direction parallel to the rotation axis of said drum, and said hollow interior is defined by relatively thin side walls extending in the direction of said primary blade axis and connecting substantially transversely extending first and second layers.

4. The apparatus of claim 3 in which said blade further comprises a relatively low modulus of elasticity material filling said hollow interior.

5. The apparatus according to claim 1 wherein said holding means further comprises means for pivoting said cleaning blade from an operative position contacting said drum surface to an inoperative position spaced away from said drum surface.

6. The apparatus of claim 5 wherein said holding means further comprises a rigid member closely spaced apart from said blade and adapted for limiting the deflection of said blade in the direction of said transverse blade axis when said blade is in said operative position.

7. The apparatus of claim 5 further comprising:

a cleaning roller, dispensing means for applying lubricating liquid onto at least one of said drum surface and said cleaning roller, and wherein said holding means is further adapted for supporting said dispensing means.

8. In an apparatus for removing residual toner from the photosensitive drum surface of a photocopying machine comprising:

(1) a rotating drum having a photosensitive surface;

(2) an elastic cleaning blade having a cleaning edge; and (3) holding means for disposing said cleaning edge of said blade for contact with the photosensitive surface of said drum along the drum surface axial length as a trailing blade, said holding means further comprising means for pivoting said cleaning blade from an operative position contacting said drum surface to an inoperative position spaced away from said drum surface;

the improvement wherein said cleaning blade comprises a layer of a relatively lower elastic modulus material disposed between layers of a relatively higher elastic modulus material, said layers extending in a direction transverse to said primary blade axis.

9. In an apparatus for removing residual toner from the photosensitive drum surface of a photocopying machine comprising:

(1) a rotating drum having a photosensitive surface;

(2) an elastic cleaning blade having a cleaning edge; and (3) holding means for disposing said cleaning edge of said blade for contact with the photosensitive surface of said drum along the drum surface axial length as a trailing blade, said holding means further comprising means for pivoting said cleaning blade from an operative position contacting said drum surface to an inoperative position spaced away from said drum surface;

the improvement wherein said cleaning blade comprises a relatively high elastic modulus material having a partially hollow interior extending in a direction parallel to the rotation axis of said drum, and said hollow interior is defined by relatively thin side walls extending in the direction of said primary blade axis and connecting substantially transversely extending first and second layers.

10. The apparatus of claim 9 wherein said blade further comprises:

a relatively low modulus of elasticity material filling said hollow interior.

11. In an apparatus for removing residual toner from the photosensitive drum surface of a photocopying machine comprising:

(1) a rotating drum having a photosensitive surface;

(2) an elastic cleaning blade having a cleaning edge;

(3) a cleaning roller disposed for contact with said photosensitive surface;

(4) dispensing means for applying lubricating liquid onto at least one of said drum surface and said cleaning roller; and (5) holding means for disposing said cleaning edge of the blade for contact with the photosensitive surface of said drum along the drum surface axial length as a trailing blade, and said holding means further comprising means for pivoting said cleaning blade from an operative position contacting said drum surface to an inoperative position away from said drum surface;

the improvement wherein said cleaning blade comprises a layer of a relatively lower elastic modulus material disposed between layers of a relatively higher elastic modulus material, said layers extending in a direction transverse to said primary blade axis, and said holding means is further adapted for supporting said dispensing means.

* * * * *